US009675977B2

(12) United States Patent
Cordonnier et al.

(10) Patent No.: US 9,675,977 B2
(45) Date of Patent: Jun. 13, 2017

(54) COMPRESSIVE GRINDER FOR A BED OF MATERIALS

(71) Applicants: Alain Cordonnier, Villeneuve D'Ascq (FR); Sebastien Devroe, Villeneuve D'Ascq (FR)

(72) Inventors: Alain Cordonnier, Villeneuve D'Ascq (FR); Sebastien Devroe, Villeneuve D'Ascq (FR)

(73) Assignee: FIVES FCB, Villeneuve D'Ascq (FR)

( * ) Notice: Subject to any disclaimer, the term of this patent is extended or adjusted under 35 U.S.C. 154(b) by 390 days.

(21) Appl. No.: 14/359,423

(22) PCT Filed: Nov. 30, 2012

(86) PCT No.: PCT/FR2012/052768

§ 371 (c)(1),
(2) Date: May 20, 2014

(87) PCT Pub. No.: WO2013/079883

PCT Pub. Date: Jun. 6, 2013

(65) Prior Publication Data

US 2014/0326810 A1 Nov. 6, 2014

(30) Foreign Application Priority Data

Dec. 2, 2011 (FR) ..... 11 03689

(51) Int. Cl.
*B02C 15/06* (2006.01)
*B02C 23/00* (2006.01)

(52) U.S. Cl.
CPC ..... *B02C 15/06* (2013.01); *B02C 23/00* (2013.01)

(58) Field of Classification Search
CPC ..... B02C 15/06; B02C 23/00
(Continued)

(56) References Cited

U.S. PATENT DOCUMENTS 1,603,639 A * 10/1926 Reed ..... B02C 17/00 241/113
2,745,748 A * 5/1956 McCashen ..... B02C 9/00 241/2

(Continued)

FOREIGN PATENT DOCUMENTS

DE 463 922 8/1928
EP 0 486 371 5/1992

(Continued)

OTHER PUBLICATIONS

International Search Report dated Apr. 8, 2013 in corresponding PCT application.

(Continued)

*Primary Examiner* — Faye Francis
(74) *Attorney, Agent, or Firm* — Young & Thompson

(57) ABSTRACT

A compressive grinder for a bed of materials, includes: a cylinder having a horizontal axis, and an inner wall having a raceway for a grinding roller arranged inside the cylinder; elements for rotating the cylinder about the axis; the grinding roller having an axis parallel to that of the cylinder; elements for urging the grinding roller against the raceway; an input for supplying material to be ground at one end of the cylinder and an outlet for ground material at the other end. The grinder includes: a smoothing roller upstream of the grinding roller in the cylinder's direction of rotation; elements for keeping the smoothing roller adjacent to and separated from the raceway, such that, upon each cylinder turn, the material consecutively passes under the smoothing roller and then under the grinding roller, the smoothing roller exerting, on the bed of materials, a pressure that smoothes the surface thereof.

16 Claims, 4 Drawing Sheets

(58) Field of Classification Search
USPC ..... 241/228
See application file for complete search history.

(56) References Cited

U.S. PATENT DOCUMENTS

| | | | | |
|---|---|---|---|---|
| 3,596,841 | A * | 8/1971 | Perry | D21B 1/063 241/228 |
| 5,205,494 | A | 4/1993 | Durinck et al. | |
| 6,179,233 | B1 * | 1/2001 | Cordonnier | B02C 23/18 241/228 |
| 6,193,177 | B1 * | 2/2001 | Chevalier | B02C 15/06 241/228 |
| 9,010,670 | B2 * | 4/2015 | Andre | B01F 9/0007 241/228 |

FOREIGN PATENT DOCUMENTS

| | | |
|---|---|---|
| EP | 0 829 303 | 3/1998 |
| EP | 0 934 120 | 10/1998 |
| JP | 03-232541 A | 10/1991 |
| JP | 2000-033278 A | 2/2000 |
| JP | 2006-218339 A | 8/2006 |
| NL | 101 034 | 11/1961 |
| WO | 97/39829 | 10/1997 |
| WO | 98/46355 | 10/1998 |

OTHER PUBLICATIONS

English Translation of Japanese Office Action issued in Application No. 2014-543961, dated Nov. 15, 2016.

* cited by examiner

COMPRESSIVE GRINDER FOR A BED OF MATERIALS

This invention relates to a compressive grinder for a bed of materials, usually referred to as a horizontal grinder with roller, as well as a method of grinding that implements such a grinder.

Such a grinder has a particular application for grinding mineral materials, in particular in a dry process, in an unrestricted manner, for the manufacture of cement clinker.

Documents EP-0.486.371 and EP-0.934.120 describe such a type of grinder that comprises a cylinder rotating according to a horizontal axis, and of which the inner wall constitutes a raceway for a grinding roller, with an axis of rotation parallel to the axis of the cylinder, applied under strong pressure on the raceway. The material is supplied at one of the ends of the cylinder and exits at the other end.

Under the effect of the rotation of the cylinder, the material passes several times between the raceway and the grinding roller, and it is known to control the number of passes thanks to devices for advancing materials, such as those described in the documents mentioned hereinabove.

In such a grinder, the material progresses from one end to the other of the cylinder, being subjected to the actions of successive grinding. As such the granulometry of the material is coarser in the portion of the grinder located near the end of the inlet, than in the portion of the grinder located near the end of the outlet.

Conventionally, the material supplied to the grinder has a coarse granulometry, with a maximum grain size able to reach 120 mm. Via the effect of the operation of the handling systems, the flow of material is subject to fluctuations, and the granulometric distribution is heterogeneous. This induces variations in the constitution and the thickness of the bed of materials and, therefore, variations in the reaction of the forces exerted by the grinding roller which result in vibrations of the grinder.

These vibrations create mechanical stresses that participate in reducing the service life of the components of the machine, and even elements in the vicinity in the grinding workshop.

It is also known from WO97/39829 a method for grinding in a wet process implemented in a grinder comprising a circular raceway and a grinding roller, able to roll on the raceway and pressed elastically onto the latter.

In this anteriority, the surface of the bed of materials is made uniform by the adding of water or another liquid sprayed under pressure by nozzles, which makes it possible to improve the distribution of the materials in a layer with a uniform thickness on the raceway.

According to an alternative of this anteriority, the grinder comprises a pre-compression roller, arranged upstream of the grinding roller. This pre-compression roller is, like the grinding roller, pressed elastically onto the circular raceway. The pre-compression roller has for function to dry by pressing the layer of material, and to prevent the water discharged by pressing above the layer of materials from reaching the grinding roller. The grinder in WO97/39829 is not suitable for the grinding of materials in a dry process. Without aspersion of liquid in order to render the surface of the bed of materials uniform, the pre-compression roller of this anteriority, which is not kept separated from the raceway, would not make it possible to render the bed of material uniform in the manner of the smoothing roller of the grinder in accordance with the invention. The purpose of this invention is to propose a horizontal cylinder grinder that overcomes the aforementioned disadvantages, of which the service life is increased in relation to horizontal cylinder grinders of prior art.

Another purpose of this invention is to propose a method for grinding implemented by a grinder in accordance with the invention.

Other purposes and advantages of the invention shall appear when reading the following description which is provided solely for the purposes of information and which does not have the intention to limit it.

As such the invention relates to a compressive grinder for a bed of materials, comprising:

- a cylinder with a horizontal axis of which the inner wall comprises a raceway for a grinding roller, arranged inside said cylinder,
- means for rotating the cylinder about its axis,
- said grinding roller, with an axis parallel to that of the axis of the cylinder,
- means for urging said grinding roller against the raceway of said cylinder,
- an inlet for supplying material to be ground located at one of the ends of said cylinder and an outlet for the ground material at the other end of said cylinder.

According to the invention, said grinder comprises:

- a smoothing roller, arranged upstream of said grinding roller in the direction of rotation of said cylinder, intended to smooth the surface of the bed of materials,
- means for keeping the smoothing roller adjacent to and separated from the raceway of said cylinder, prohibiting any contact between said smoothing roller and the raceway.

According to the invention, said means for keeping the smoothing roller adjacent to and separated from the raceway of said cylinder, on the one hand, and said means for urging said grinding roller against the raceway of said cylinder, on the other hand, as such that said smoothing roller is able to exert on the bed of materials a pressure that smoothes its surface, said pressure being lower than the pressure exerted by said grinding roller on said bed of materials.

Such a grinder allows for the implementing of a method for compressive grinding of a bed of materials wherein, during each turn of the cylinder, the material consecutively passes under the smoothing roller then under the grinding roller, said smoothing roller exerting on the bed of materials a pressure that smoothes its surface, said pressure being lower than the pressure exerted by said grinding roller on said bed of materials.

According to an embodiment of the method for grinding said means for keeping the smoothing roller guarantees a minimum distance between the raceway and the surface of said smoothing roller, and wherein the grinder is supplied with a determined maximum grain size between 1 mm and 120 mm and said minimum distance greater than or equal to 0.5 times the determined maximum grain size is determined.

According to optional characteristics of the invention, taken individually of in a combination:

- the smoothing roller can freely rotate, able to be driven in rotation about its axis thanks to the friction with the bed of materials;
- the grinder has motor means for driving in rotation the smoothing roller in such a way that its peripheral speed is equal to the average speed of the bed of materials whereon said smoothing roller is intended to be applied;

the grinder is intended process grains with a maximum size between 1 mm and 120 mm and wherein the diameter of the smoothing roller is between 100 mm and 660 mm;

said means for keeping the smoothing roller include means of articulation, able to allow for the displacement of said smoothing roller according to a substantially radial direction towards the axis of said cylinder and elastic means forcing said smoothing roller in the opposite direction, towards raceway;

said means of keeping said smoothing roller provide for the maintaining of said smoothing roller by its two ends, said means of keeping comprising two arms, each one articulated, on the one hand, at one of the ends of said arm to said smoothing roller, according to the axis of said smoothing roller and, on the other hand, at the other end of said arm to a frame of said grinder, according to an axis of rotation parallel to the axis of said cylinder;

the length of said smoothing roller is greater than or equal to the length of said grinding roller, said smoothing roller being arranged in correspondence with said grinding roller according to the length of the cylinder;

the grinder has means for controlling the displacement of the material over the length of said cylinder in such a way that said material travels only a fraction of the length of the cylinder at each turn of the cylinder and passes several times between the cylinder and the grinding roller, from said inlet for supplying material to be ground to said outlet of ground material and wherein the distance between the surface of said smoothing roller and the raceway varies according to the length of said cylinder, decreasing from said inlet to said outlet;

said means for urging said grinding roller against the raceway of said cylinder are such that the grinding roller exerts on the bed of materials an average pressure between 10 MPa and 40 MPa and said means for keeping the smoothing roller are such that the smoothing roller exerts on the bed of materials a pressure lower than 10 MPa, more preferably lower than 1 MPa;

the axis of rotation of the smoothing roller is parallel to the axis of said cylinder.

According to an embodiment of the method for grinding, said grinder is supplied with a material of a determined maximum grain size and the diameter of said smoothing roller is chosen in the following way:

between 2 times and 6 times said maximum size of the grains to be ground if, in this condition, the diameter of the smoothing roller is greater than or equal to 0.15 times the diameter of the grinding roller and, otherwise, at least equal to 0.15 times the diameter of the grinding roller.

The invention also relates to a method for compressive grinding of a bed of materials implemented by means of a grinder in accordance with the invention, of which the means for keeping comprise said means of articulation and wherein said grinder is supplied with a material of a determined maximum grain size and the course of displacement of said smoothing roller is adjusted in such a way as to keep the surface of the smoothing roller separated from the raceway between 0.5 times and 3 times the maximum size of the grains to be ground.

The method for grinding and the grinder in accordance with the invention have a particular application for the grinding of materials in a dry process.

The invention shall be better understood when reading the following description accompanied with annexed drawings among which:

Figure 1:
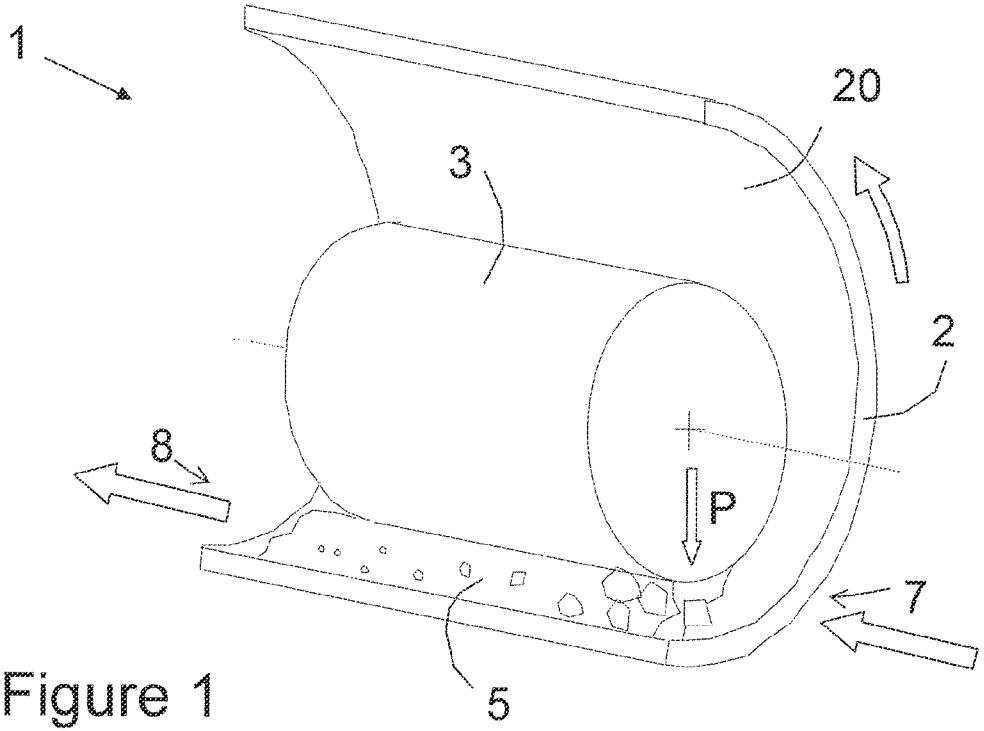
FIG. 1 is a diagrammatical view of a grinder in accordance with the invention, according to a vertical section, showing the cylinder and the grinding roller (smoothing roller not visible).
Figure 2:
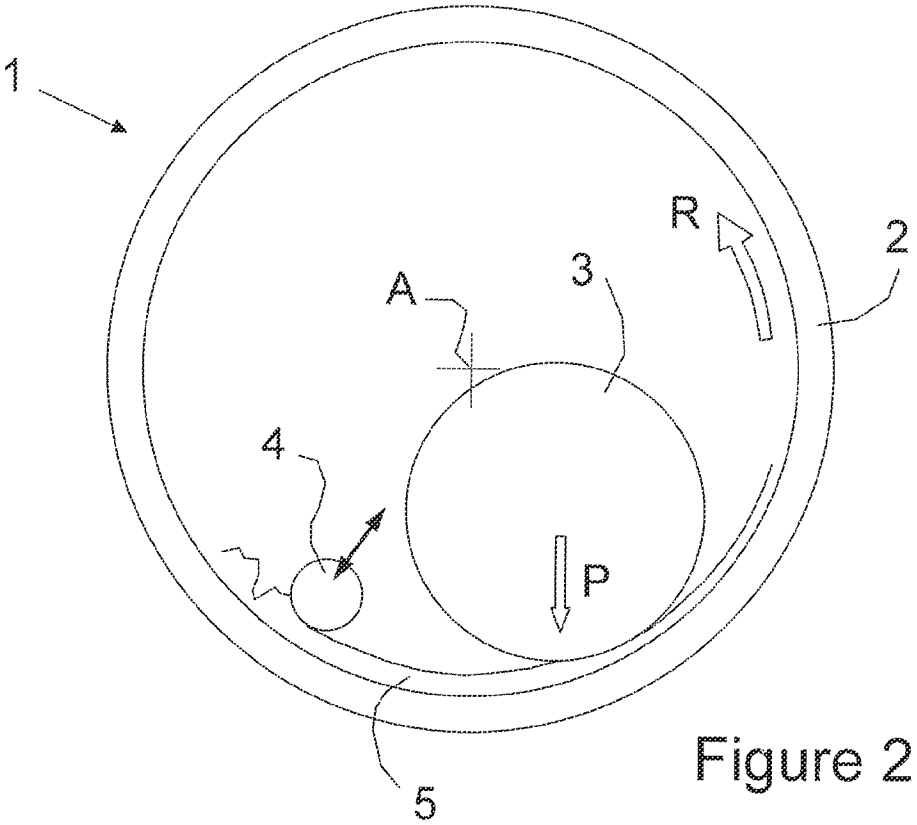
FIG. 2 is a diagrammatical side view of the grinder according to FIG. 1.
Figure 3:
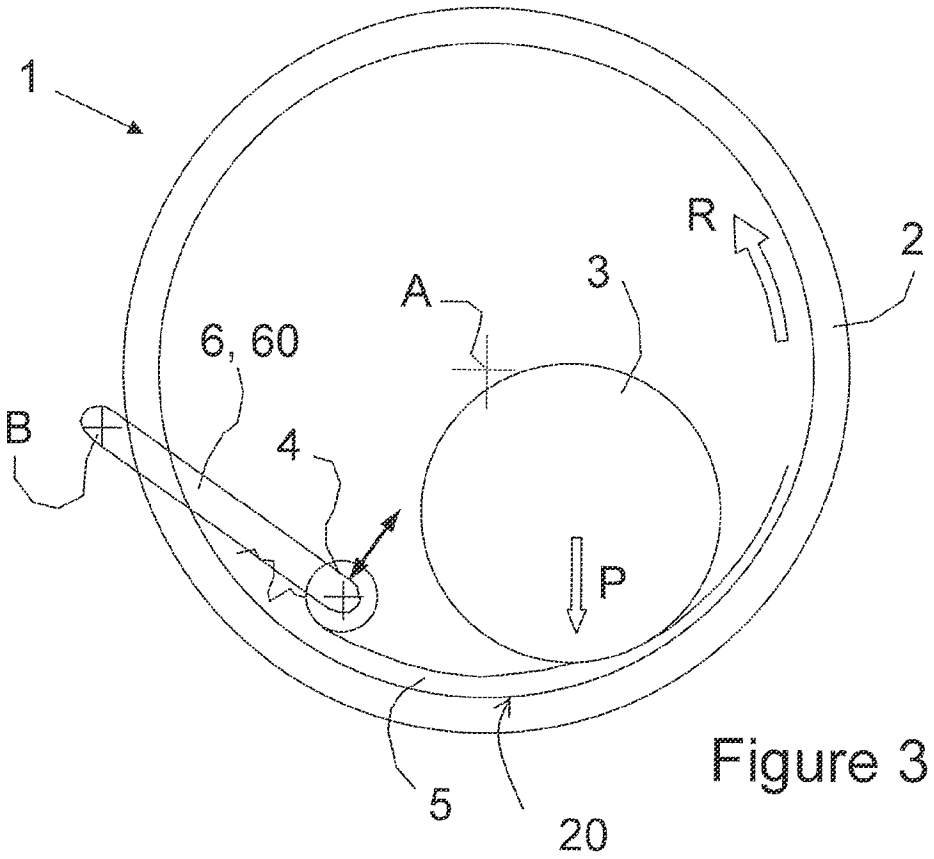
FIG. 3 is a diagrammatical view of the grinder according to FIG. 2, showing more particularly said means for keeping said smoothing roller, according to an embodiment that is not restricted.

As such the invention relates to a compressive grinder 1 for a bed of materials 5, comprising:

a cylinder 2 with a horizontal axis A of which the inner wall comprises a raceway 20 for a grinding roller 3, arranged inside said cylinder 2, means for rotating the cylinder about its axis A, said grinding roller 3, with an axis parallel to that of the axis A of the cylinder 2, means for urging said grinding roller 3 against the raceway 20 of said cylinder 2, an inlet 7 for supplying material to be ground located at one of the ends of said cylinder 2 and an outlet 8 for the ground material at the other end of said cylinder 2.

Said means for rotating the cylinder 2 can include a gear motor of which the outlet axis has a pinion coupled to a ring gear, integral with the outer wall of the cylinder 2.

Said means for urging said grinding roller 3 against the raceway 20 can include sliders that guide the ends of the grinding roller 3, as well as cylinders or springs able to exert on the ends of the grinding roller 3 efforts which are transmitted to the grinding roller 3.

According to an embodiment, said means for urging said grinding roller 3 against the raceway 20 of said cylinder 2 are such that the grinding roller 3 exerts on the bed of materials 5 an average pressure between 10 MPa and 40 MPa.

The supplying of materials at the inlet 7 and/or the removal of materials at the outlet 8 can be obtained my means of a pneumatic handling system.

Preferably, the grinder has means (not shown) to control the displacement of the material over the length of said cylinder 2 in such a way that said material travels only a fraction of the length of the cylinder 2 at each turn of the cylinder 2 and passes several times between the cylinder 2 and the grinding roller 3 from said inlet 7 for supplying material to be ground to said outlet 8 of ground material.

These means can include a device intended to provide for the advancing of the material, from one end to the other of the cylinder 2 such as in particular described in EP-0.486.371 or EP-0.934.120.

Such a device comprises a scraper (or knife) placed inside the cylinder, in the descending upper portion, in such a way as to detach the material from the raceway and one, or more preferably, several deflective plates arranged under the scraper in such a way as to intercept the material detached by the latter and divert it towards the outlet of the grinder.

According to the invention, the grinder comprises:

a smoothing roller 4 arranged upstream of said grinding roller 3 in the direction of rotation R of said cylinder 2, means for keeping 6 the smoothing roller 4 adjacent to and separated from the raceway of said cylinder 2.

The means 4, 6 are such that, at each turn of the cylinder 2, the material consecutively passes under the smoothing roller 4 the under the grinding roller 3, said smoothing roller 4 exerting on the bed of materials 5 a pressure that smoothes its surface, said pressure being lower than the pressure P exerted by said grinding roller 3 on said bed of materials 5.

Preferably, during operation the pressure of the smoothing roller on the bed of materials 5 is lower than the pressure required to grind the particles of material. To this effect, said means for keeping 60 the smoothing roller 4 are such that the smoothing roller 4 exerts on the bed of materials 5 a pressure lower than 10 MPa, more preferably lower than 1 MPa.

Preferably, the length of said smoothing roller 4 can be greater than or equal to the length of said grinding roller 3, said smoothing roller 4 being arranged in correspondence with said grinding roller 3 according to the length of the cylinder 2.

According to the invention, said means for keeping 6 the smoothing roller 4 guarantee a minimum distance between the raceway 20 and the surface of said smoothing roller 4, prohibiting any contact between said smoothing roller 4 and the raceway 20.

This minimum distance makes it possible to ensure that the grainy materials of the bed of materials can be flushed laterally, according to the axis of the roller, under the action of said smoothing roller 4, and as such obtain a bed of materials with a constant thickness over the length of the smoothing roller 4. This minimum distance can be determined according to the maximum grain size supplying the grinder which can be between 1 mm and 120 mm. According to an embodiment, the minimum distance is greater than or equal to 0.5 times the determined maximum grain size.

According to an embodiment, the smoothing roller 4 can freely rotate, able to be driven in rotation about its axis thanks to the friction with the bed of materials 5.

Alternatively, the grinder can have motor means for driving in rotation the smoothing roller 4 in such a way that its peripheral speed is equal to the average speed of the bed of materials 5 whereon said smoothing roller 4 is intended to be applied.

According to an embodiment, the grinder 1 is intended to grind grains with a maximum size between 1 mm and 120 mm, with the diameter of the smoothing roller 4 being then between 100 mm and 660 mm.

Preferably, said grinder 1 is supplied with a material with a determined maximum grain size and the diameter of said smoothing roller 4 is chosen in the following way:

- between 2 times and 6 times said maximum size of the grains to be ground if, in this condition, the diameter of the smoothing roller is greater than or equal to 0.15 times the diameter of the grinding roller 3 and, otherwise,
- at least equal to 0.15 times the diameter of the grinding roller 3, in particular lower than 0.5 times the diameter of the grinding roller 3.

Said means of keeping 6 the smoothing roller 4 can include means of articulation, able to allow for the displacement of said smoothing roller 4 according to a substantially radial direction to the axis A of said cylinder 2 and elastic means (not shown) forcing said smoothing roller 4 in the opposite direction, towards the raceway (20).

According to an embodiment, said means of keeping 6 said smoothing roller 4 provide for the maintaining of said smoothing roller 4 by its two ends, said means of articulation of said means for keeping 6 comprising two arms 60, each one articulated, on the one hand, at one of the ends of said arm 60 to said smoothing roller 4, according to the axis of said smoothing roller 4 and, on the other hand, at the other end of said arm 60 to a frame of said grinder 1, according to an axis of rotation B, in particular parallel to the axis A of said cylinder 2.

Preferably, the course of displacement of the smoothing roller 4 is limited by said means of keeping 6.

Advantageously, said grinder 1 is supplied with a material of a determined maximum grain size and the course of displacement of said smoothing roller 4 is adjusted in such a way as to keep the surface of the smoothing roller 4 separated from the raceway 20 between 0.5 times and 3 times the maximum size of the grains to be ground. The course of displacement of the smoothing roller 4 can be such that the smoothing roller 4 sweeps this entire value range.

According to an embodiment, the grinder 1 has said means to control the displacement of the material over the length of said cylinder 2 in such a way that said material travels only a fraction of the length of the cylinder 2 at each turn of the cylinder 2 and passes several times between the cylinder 2 and the grinding roller 3 from said inlet 7 for supplying material to be ground to said outlet 8 of ground material.

Figure 4:
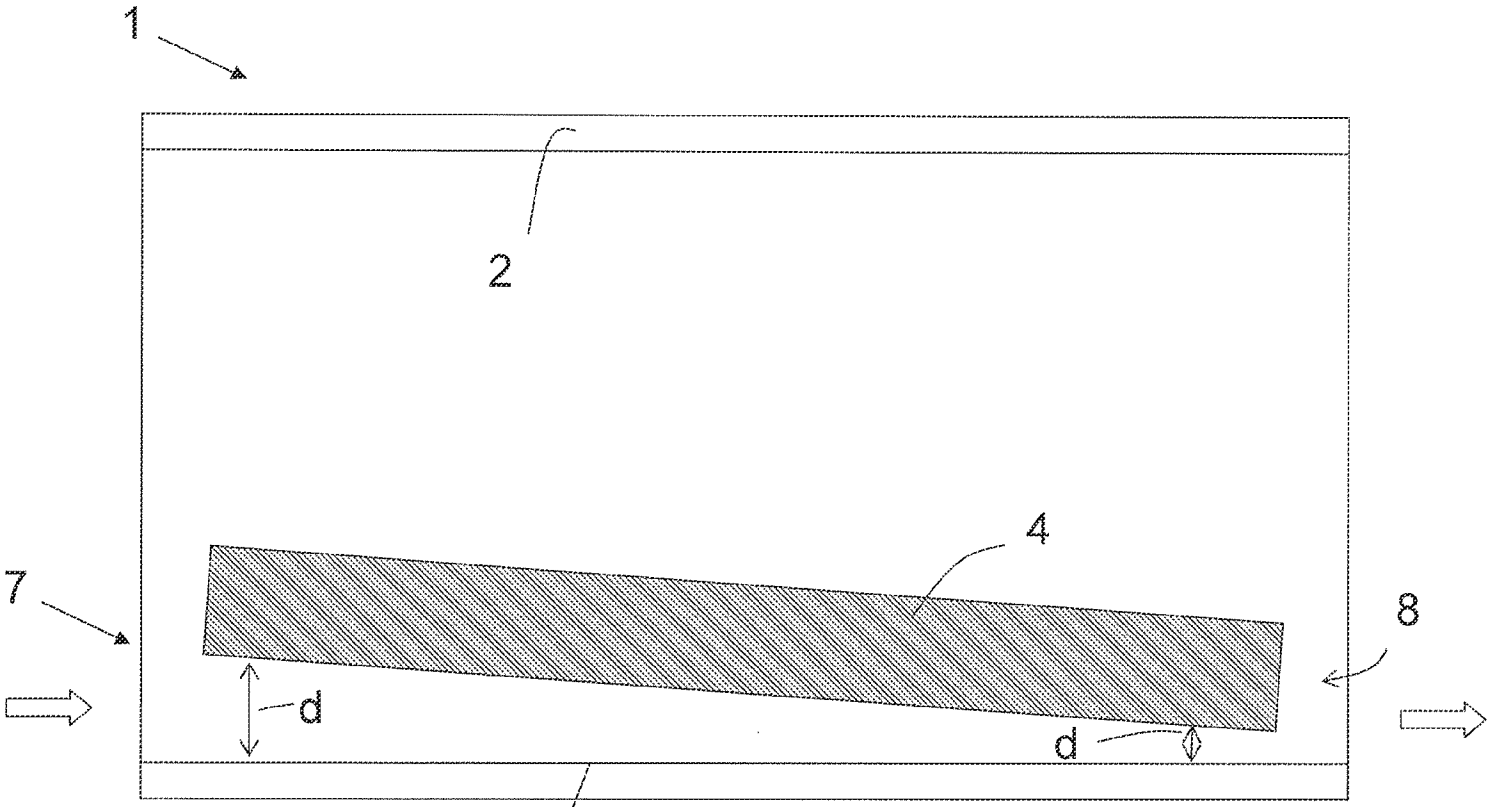
FIG. 4 is a cross-section view of a grinder in accordance with the invention according to a second embodiment, showing the cylinder and the smoothing roller (grinding roller not visible).

Advantageously, according to this latter embodiment, the distance "d" between the surface of said smoothing roller 4 and the raceway 20 can be variable according to the length of said cylinder 2, decreasing from said inlet 7 to said outlet 8. To this effect and according the example shown in FIG. 4, the axis of the smoothing roller 4 can be inclined in relation to the axis of the cylinder 2.

This arrangement makes it possible to take into account the fact that the granulometry of the material is coarser in the portion of the grinder located near the end of the inlet 7 than in the portion of the grinder located near the end of the outlet 8.

As such the distance between the surface of the smoothing roller 4 and the raceway 20 at the end of the roller on the side of the inlet 7 is greater than the distance between the surface of the smoothing roller 4 and the raceway 20 at the end of the roller on the side of the outlet 8. The ratio between the two distances can be between 1 and 2.

Alternatively the axis of rotation of the smoothing roller 4 is parallel to the axis A of said cylinder 2.

The grinder and the methods for grinding in accordance with the invention have a particular application for the grinding of mineral materials and/or the grinding of materials in the manufacture of cement clinker, in particular in a dry process.

Naturally, other embodiments could have been considered by those skilled in the art without however leaving the scope of the invention such as defined by the claims hereinafter.

NOMENCLATURE

1. Grinder,
2. Cylinder,
3. Grinding roller,
4. Smoothing roller,
5. Bed of materials,
6. Means of keeping (smoothing roller),
7. Inlet,
8. Outlet,
20. Raceway,
60. Arm (Means of articulation),
A. Horizontal axis,
B. Axis of rotation, P. Pressure, R. Direction of rotation.

The invention claimed is:

1. A method of grinding by compression of a bed of materials comprising the steps of:

providing a compressive grinder (1) for a bed of materials (5), comprising:

a cylinder (2) with a horizontal axis (A), two ends, a length extending along the horizontal axis (A) between the two ends, and an inner wall comprising a raceway (20) for a grinding roller (3), arranged inside said cylinder (2), means for rotating the cylinder about an axis (A), said grinding roller (3), with an axis parallel to that of the axis (A) of the cylinder (2), said grinding roller (3) having a length extending along the axis parallel to that of the axis (A) of the cylinder (2), means for urging said grinding roller (3) against the raceway (20) of said cylinder (2), an inlet (7) for supplying materials to be ground located at one of the ends of said cylinder (2) and an outlet (8) for the ground materials at the other end of said cylinder (2), a smoothing roller (4) arranged upstream of said grinding roller (3) in the direction of rotation (R) of said cylinder (2), the smoothing roller (4) having a surface configured to smooth a surface of the bed of materials, the smoothing roller (4) having two ends, each end being proximate to one of the ends of said cylinder (2), and means for keeping (6) the smoothing roller (4) adjacent to and separated from the raceway of said cylinder (2), prohibiting any contact between said smoothing roller (4) and the raceway (20);

supplying materials to be ground at said inlet (7);

rotating said cylinder (2) in order to form a bed of materials on the inner wall of said cylinder (2);

controlling displacement of the materials over the length of said cylinder (2) in such a way that said materials travel only a fraction of the length of the cylinder (2) at each turn of the cylinder (2) and passes several times between the cylinder (2) and the grinding roller (3) from said inlet for supplying materials to be ground to said outlet of ground materials;

wherein, at each turn of the cylinder (2), said method comprises the steps of:

levelling said bed of materials by applying a pressure to a surface of said bed with said smoothing roller (4); and grinding said materials by applying a pressure on the surface of the levelled bed of materials with said grinding roller (3), and wherein the pressure of said smoothing roller on the surface of the bed of materials is lower than 1 MPA and lower than the pressure (P) exerted by said grinding roller (3) on said surface of the levelled bed of materials (5).

2. The method for grinding according to claim 1, wherein said means of keeping (6) the smoothing roller (4) guarantee a minimum distance between the raceway (20) and the surface of said smoothing roller (4), and wherein the grinder has a maximum grain size between 1 mm and 120 mm and said minimum distance is greater than or equal to 0.5 times the maximum grain size.

3. The method for grinding according to claim 2, wherein the smoothing roller (4) can freely rotate, driven in rotation about the axis A due to the friction with the bed of materials (5).

4. The method for grinding according to claim 2, having motor means for driving in rotation the smoothing roller (4) to provide a peripheral speed equal to an average speed of the bed of materials (5) whereon said smoothing roller (4) is applied.

5. The method for grinding according to claim 1 wherein grains of a maximum size between 1 mm and 120 mm are processed and wherein the smoothing roller (4) has a diameter between 100 mm and 660 mm.

6. The method for grinding according to claim 1, wherein said means for keeping (6) the smoothing roller (4) adjacent to and separated from the raceway of said cylinder (2) comprises means of articulation, able to authorise the displacement of said smoothing roller (4) according to a substantially radial direction towards the axis (A) of said cylinder (2) and elastic means forcing said smoothing roller (4) in the opposite direction, towards the raceway (20).

7. The method for grinding according to claim 6, wherein said means for keeping (6) said smoothing roller (4) adjacent to and separated from the raceway of said cylinder (2) provide for the maintaining of said smoothing roller (4) by the two ends, said means of articulation of said means of keeping (6) comprising two arms (60), each one articulated, at one end of each arm (60) to said smoothing roller (4), according to the axis of said smoothing roller (4) and at the other end of each arm (60) to a frame of said grinder (1), according to an axis of rotation (B) parallel to the axis (A) of said cylinder (2).

8. The method for grinding according to claim 6, wherein said grinder (1) is supplied with a materials of a determined maximum grain size and the course of displacement of said smoothing roller (4) is adjusted in such a way as to keep the surface of the smoothing roller (4) separated from the raceway (20) between 0.5 times and 3 times the maximum size of the grains to be ground.

9. The method for grinding according to claim 1, wherein said smoothing roller (4) has a length greater than or equal to the length of said grinding roller (3), said smoothing roller (4) being arranged in correspondence with said grinding roller (3) according to the length of the cylinder (2).

10. The method for grinding according to claim 1, having means for controlling the displacement of the materials over the length of said cylinder (2) in such a way that said materials travel only a fraction of the length of the cylinder (2) at each turn of the cylinder (2) and passes several times between the cylinder (2) and the grinding roller (3) from said inlet (7) for supplying materials to be ground to said outlet (8) of ground materials and wherein the distance (d) between the surface of said smoothing roller (4) and the raceway (20) varies according to the length of said cylinder (2), decreasing from said inlet (7) to said outlet (8).

11. The method for grinding according to claim 1, wherein the axis of rotation of the smoothing roller (4) is parallel to the axis (A) of the cylinder (2).

12. The method for grinding according to claim 1, wherein said means for urging said grinding roller against the raceway of said cylinder are such that the grinding roller (3) exerts on the bed of materials an average pressure between 10 MPa and 40 MPa and said means for keeping (6) the smoothing roller are such that the smoothing roller (4) exerts on the bed of materials (5) a pressure lower than 1 MPa.

13. The method for grinding according to claim 1, further comprising the steps of:

supplying said grinder (1) with a material of a determined maximum grain size, and selecting the diameter of said smoothing roller (4) as at least equal to 0.15 times the diameter of the grinding roller (3), and between 2 times and 6 times said determined maximum grain size, if the diameter of the smoothing roller based on the determined maximum grain size is greater than or equal to 0.15 times the diameter of the grinding roller (3).

14. The method for grinding according to claim 1 wherein the materials are ground in said grinder (1) in a dry process.

15. The method for grinding according to claim 1, wherein the materials are mineral materials and/or materials from manufacturing of cement clinker.

16. A compressive grinder (1) for a bed of materials (5), comprising:

a cylinder (2) with a horizontal axis (A), two ends, a length extending along the horizontal axis (A) between the two ends, and an inner wall comprising a raceway (20) for a grinding roller (3), arranged inside said cylinder (2), means for rotating the cylinder about an axis (A), said grinding roller (3), with an axis parallel to that of the axis (A) of the cylinder (2), said grinding roller (3) having a length extending along the axis parallel to that of the axis (A) of the cylinder (2), means for urging said grinding roller (3) against the raceway (20) of said cylinder (2), an inlet (7) for supplying materials to be ground located at one of the ends of said cylinder (2) and an outlet (8) for the ground materials at the other end of said cylinder (2), means for controlling the displacement of the materials over the length of said cylinder (2) in such a way that said materials travel only a fraction of the length of the cylinder (2) at each turn of the cylinder (2) and passes several times between the cylinder (2) and the grinding roller (3) from said inlet (7) for supplying materials to be ground to said outlet (8) of ground materials, a smoothing roller (4) arranged upstream of said grinding roller (3) in the direction of rotation (R) of said cylinder (2), said smoothing roller (4) having a surface configured to smooth the surface of the bed of materials, means for keeping (6) the smoothing roller (4) adjacent to and separated from the raceway of said cylinder (2), prohibiting any contact between said smoothing roller (4) and the raceway (20), and wherein said means for keeping (6) the smoothing roller (4) adjacent to and separated from the raceway of said cylinder (2) and said means for urging said grinding roller (3) against the raceway (20) of the cylinder (2) are such that said smoothing roller (4) is able to exert on a surface of the bed of materials (5) a pressure that levels said surface, said pressure being lower than the pressure (P) exerted by said grinding roller (3) on said bed of materials (5), the compressive grinder being configured in order that, at each turn of the cylinder (2):

said smoothing roller (4) exerts sufficient pressure for levelling the surface of said bed of materials (5), and said grinding roller (3) exerts sufficient pressure to grind the levelled surface of the said bed of materials (5).

* * * * *